United States Patent [19]

Tokunaga et al.

[11] Patent Number: 4,584,044

[45] Date of Patent: Apr. 22, 1986

[54] METHOD OF HEATING AND REMOVING FUSIBLE ROAD MARKINGS FROM A ROAD SURFACE

[75] Inventors: Yasuyuki Tokunaga, Urawa; Shozo Fukushima, Tokyo, both of Japan

[73] Assignees: Marusho Kagaku K.K.K.; Nihon Sanka Kogo K.K.K., both of Tokyo, Japan

[21] Appl. No.: 347,971

[22] Filed: Feb. 11, 1982

Related U.S. Application Data

[63] Continuation of Ser. No. 100,929, Dec. 6, 1979, abandoned.

[30] Foreign Application Priority Data

Dec. 28, 1978 [JP] Japan ..... 53-163674
Dec. 28, 1978 [JP] Japan ..... 53-163675

[51] Int. Cl.[4] ..... B32B 31/26; B32B 35/00

[52] U.S. Cl. ..... 156/344; 126/263; 126/271.1; 126/271.3; 156/71; 156/82; 156/155; 156/247; 156/249; 156/272.2; 156/309.9; 156/322; 404/77; 404/79; 404/94; 404/95

[58] Field of Search ..... 156/71, 272.2, 82, 309.9, 156/155, 322, 247, 344, 249; 404/77, 94, 79, 95; 126/271.1, 271.3, 263; 44/3 C; 428/913; 149/109.2; 427/316

[56] References Cited

U.S. PATENT DOCUMENTS

| | | | |
|---|---|---|---|
| 2,836,172 | 5/1958 | Ginsburgh et al. | 126/263 |
| 3,051,509 | 8/1962 | Wilton et al. | 285/21 |
| 3,307,997 | 3/1967 | Detrick | 126/263 |
| 3,311,459 | 3/1967 | Francis et al. | 126/263 |
| 3,410,185 | 11/1968 | Harrington | 404/77 |
| 3,451,696 | 6/1969 | Hagelin et al. | 285/21 |
| 3,637,181 | 1/1972 | Janssen | 248/205.3 |
| 4,001,152 | 1/1977 | Leonhardt | 126/263 |
| 4,221,620 | 9/1980 | Milne | 156/344 |

*Primary Examiner*—John J. Gallagher
*Attorney, Agent, or Firm*—Brisebois & Kruger

[57] ABSTRACT

This invention concerns treatment of the heat-fusible materials by use of a fusing agent, according to which a fusing agent capable of producing red hot "embers" by combustion is applied to the surface of a worked object such as a sign formed from a heat-fusible material and worked at a construction site or to the area to be newly worked, and then said fusing agent is ignited and burned so that the combustion heat of the resultantly produced "embers" is directly conducted to the material to be worked to thereby remove the fused material from the worked area or fuse and affix the material to the working area.

5 Claims, 15 Drawing Figures

FIG. 8
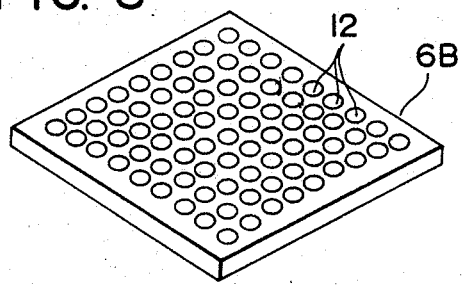
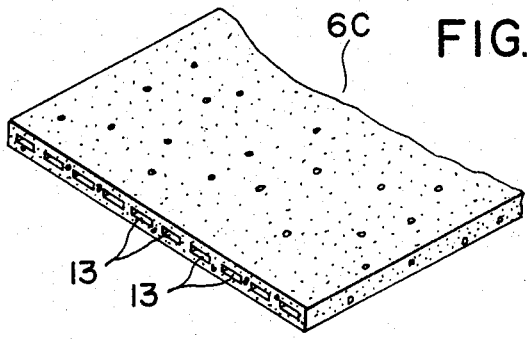
FIG. 9
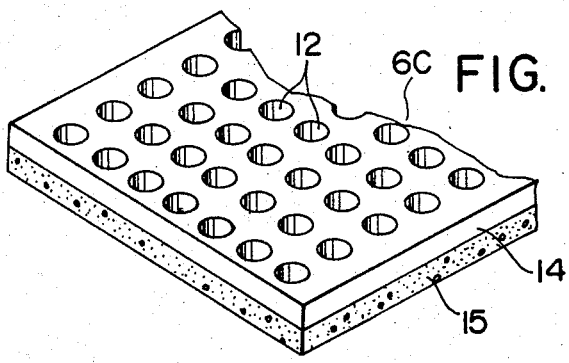
FIG. 10

METHOD OF HEATING AND REMOVING FUSIBLE ROAD MARKINGS FROM A ROAD SURFACE

This is a continuation of application Ser. No. 100,929, filed Dec. 6, 1979, now abandoned.

FIELD OF THE INVENTION

This invention relates to a fusing and treating method for the heat-fusible materials used for construciton works and a fusing agent for the heat-fusible materials used in practicing such method. More particularly, it relates to said fusing and treating method according to which combustion heat of "embers" produced from ignition and combustion of the fusing agent is directly conducted to a material to be worked to fuse said material so as to remove it from the worked face or area or to fusion-bond said material to the area to be newly worked, and a fusing agent used in such method.

BACKGROUND OF THE INVENTION

Heretofore, in case of performing road marking or such by applying a fused paint on the road surface, or providing asphalt roofing on the roof or floor of a building, or executing a work on a playground, garden, corridor or such with a heat-fused synthetic resin, synthetic rubber, etc., such work must be carried out by heat-fusing the material during transportation thereof or at the site of the work. In the case of road marking, for instance, a powdered paint must be treated in a kneader tank at around 220° C. under stirring to adjust its viscosity before it is applied on the road surface.

In case of removing such paint from the worked face or area or making repairs of the making, it has been generally practiced to scrape or cut off the fixed material (paint) with a rotary scraper or to fuse and burn out the material with a burner. Such operation, however, was very trublesome and time-consuming and required large-scale equipments and many work hands. Particularly, the works on the road or on the rooftop are attended with a danger of an accident resulting in injuries or death of the worker. There is also involved the problem of environmental pollution such as noise created by the scraping or cutting operation or atmospheric air contamination due to evolution of fume or odor from burner combustion.

Further, because of time limit for the road work and also for the necessity of minimizing traffic backup and danger, accomplishment of quick and perfect work has been an essential requirement.

SUMMARY OF THE INVENTION

An object of this invention is to provide a method for removing road marks or other heat-fusible material from the face or area on which such marks exist, or for promptly accomplishing new raod marking or other works on the face or area to be worked, with no need of using any equipments and apparatuses which have been essential requirements in the conventional methods.

Another object of this invention is to provide a fusing agent for the heat-fusible material to be treated, said fusing agent being capable of producing red hot "embers" immediately after ignition and burning and maintaining its combustion for a determined period of time to conduct high-temperature heat to the subject material.

Still another object of this invention is to provide a method according to which a solid-state fusing agent is applied on the material or area to be worked and then ignited and burned by means of high-pressure sparks or a fuse to thereby effect positive working or removal of the material.

Yet another object of this invention is to provide a method which allows execution of the work without causing evolution of flames and smoke during ignition and combustion of the fusing agent and emission of any offensive odor from the "embers".

A further object of this invention is to provide a fusing agent which can be prepared into a plate-like from to facilitate storage and treatment thereof.

It is another object of this invention to provide a fusing agent of which combustion rate and combustion heat can be freely controlled by suitably selecting configuration, structure and blend of the plate-shaped fusing agent.

An additional object of this invention is to provide a fusing agent of which "embers" produced from combustion can maintain shape even in a red hot condition to allow proper and accurate removal of the material or working thereof.

Other objects and features of this invention will become more apparent from the following detailed description of the invention and the accompanying drawings.

In the drawings:

FIGS. 8–10 are prespective views showing other embodiments of fusing agent according to this invention.

DETAILED DESCRIPTION OF THE INVENTION

Figure 1:
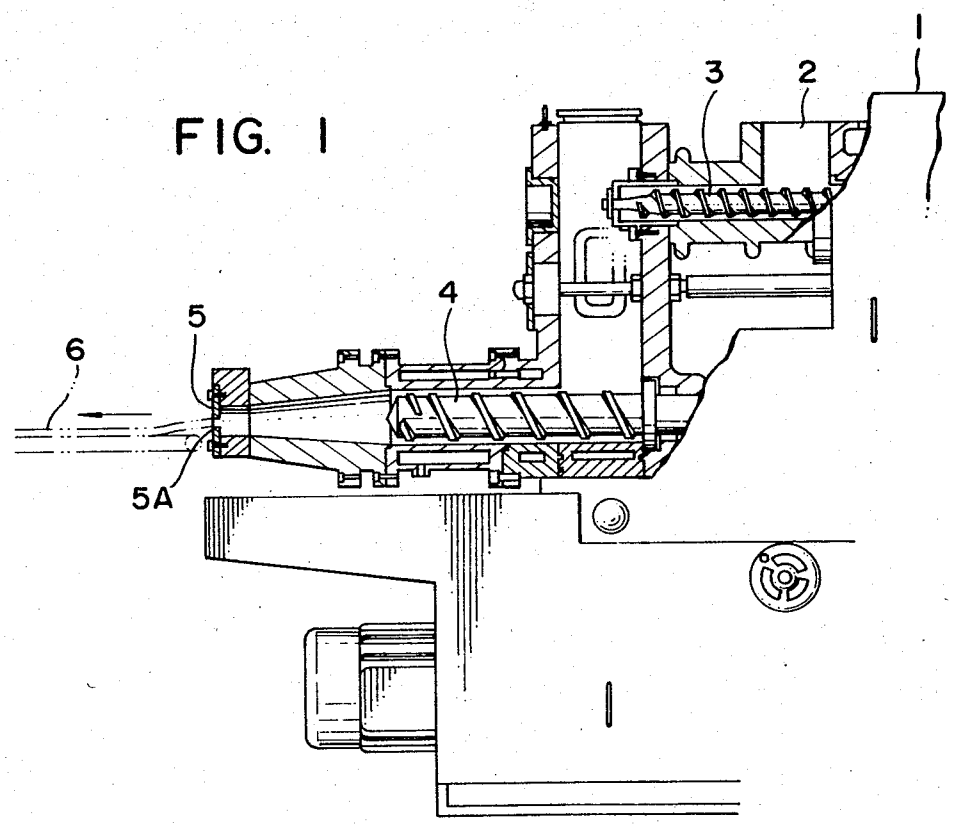
FIG. 1 is a side view, partly shown in section, illustrating an example of the apparatus used for working of a fusing agent in accordance with this invention.

This invention relates to a heat-fusible material treating method according to which a heat-fusible material for construction works is heated and fused by making use of direct solid-to-solid heat conduction to thereby remove the material from its worked area or to effect fusion-adhesion of the material on the area to be worked. The fusing agent used for fusing the material to be worked in this invention is principally composed of one or two or more carbonaceous fuel blends having different ignition temperatures and incorporated with an oxidation exothermic agent, the mixture being further added, where necessary, with a pertinent igniting agent, combustion assistant, binder and the like and kneaded into a paste-like mass and further molded into a plate-like product, or the mixture is applied on an inflammable plate-shaped base and dried. The respective component materials of this fusing agent are explained in detail hereinbelow.

(A) Oxidation exothermic agent

Nitrates and perhydrochlorides are suited for use as oxidation exothermic agent in this invention. Perhydrochloride is used in a trace amount for adjusting the combustion rate of the fuel, and the substantial portion of the requirement is supplied by a nitrate to ensure safety against undesirable such as sputtering. Sodium nitrate or barium nitrate is preferred for use as nitrate in this invention. As for perhydrochloride, it is recommended do use a trace amount of sodium perhydrochloride for adjustment of the combustion rate.

(B) Inflammable material

At least one of the following carbonaceous fuel blends with different ignition temperatures is used.

(a) As carbonaceous solid fuel, it is recommendable to use paper charcoal, pine charcoal, paulownia charcoal, cinders, charcoal, anthracite and other amorphous carbon compounds or organic compounds. Powdery material such as crude ash, is preferred.

Their reducing property to deprive the oxide of oxygen in a high-temperature condition affects the keeping time of "embers". Paper charcoal, pine charcoal, paulownia charcoal, cinders and such are low in ignition temperature. It is 320°-324° C. in the case of charcoal and 400°-500° C. in the case of anthracite.

The following materials may be added where necessary.

(b) Papers made from natural fibers, and raw cotton, hemp, wool, silk, asbestos, etc. Wood pulp paper is preferred. These materials provide a tie or stopgap when solidified.

(c) Inflammable high-molecular compound fibers such as nylon, tetron, vinylon, etc., are known, but other material which is easy to burn may be used. These materials are also easily solidifed. Polyolefinic cellulose and foamed plastics also give good burning.

(C) Binder

Ethylene glycol is most suited as binder for the composition of this invention. Other inflammable binders such as ethylene oxide, carboxymethyl cellulose, paraffin, glue, dextrin, etc., may be used, but these materials have problems in tackiness and evolution of sooty smoke and nasty smell. However, they may be used more favorably in admixture with other components, for example, water paste and such. In the case of ethylene glycol, it is desirable to determine its loading such that it is burned out immediately after formation of red hot "embers" of the solid fuel.

Other materials such as shown below may be further added at need.

(D) Igniting agent

An organic alcohol may be directly added in the mixture, but since the igniting agent used in this invention needs to be involatible, there is preferably used a saponified pastelike involatile solid alcohol prepared by adding an alkali hydroxide to a fatty acid, heating the mixture at around 60° C. and further adding an alcohol during cooling of the mixture.

This solid alcohol not only proves helpful for igniting the inflammable material but is also capable of decomposing the oxidizing agent. It can also act as a material binder.

(E) Combustion assistant

Combustion assistant is one which generates heat to perfectly decompose the oxidizing agent, and hexamethylenetetramine is preferred as such combustion assistant. Hexamethylenetetramine has high sublimation temperature (about 263° C.) and is also higher than alcohols in heat release value by about 60%.

(F) Combustion retardant

Ceramics or materials therefore, such as kaolin, clays, magnesium oxide, alumina, aluminum hydroxide, montmorillonite, kaolinite, bentonite, chamotte, etc., are usable as combustion retardant. These materials are principally composed of silicates and other oxide minerals, and most of them induce a chemical reaction upon exposure to a high temperature. The fused salt, which is "embers" in this invention, is also a high-temperature reaction product. Fine powder of aluminum hydroxide or bentonite is most preferred as combustion retardant and also recommendable because of solidness of its ash after combustion.

COMBUSTION MECHANISM

A paste-like fusing agent prepared from a mixture of said component materials is first worked into the form of a sheet and this sheet is laid on the surface of the paint or other heat-fusible worked material to be eliminated or on the face or area to be newly worked, and then the sheet is ignited, whereby the igniting agent is burned to generate heat, such combustion heat reaching the decomposition temperature (400°-600° C.) of the oxidizer, and red hot "embers" are formed by combustion of the inflammable material. The condition of red hot "embers" is kept for a given period of time so that the area contacted with said fusing agent is maintained heated to a high temperature for the given period of time. The worked material is fused by this heat and separated from the working face, or the material is fused and stuck to the working area heated by said "embers".

Now, the method of producing the fusing agent is described.

Figure 2:
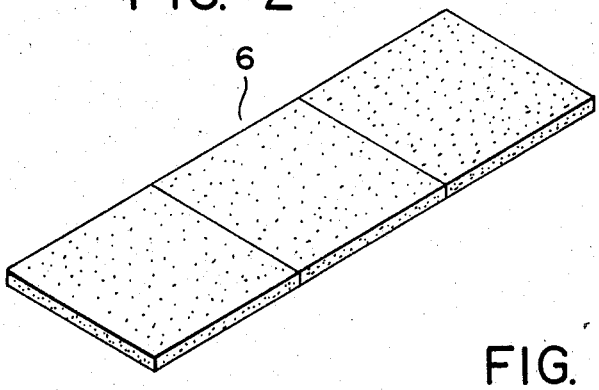
FIG. 2 is a perspective view of an embodiment of fusing agent according to this invention.
Figure 3:
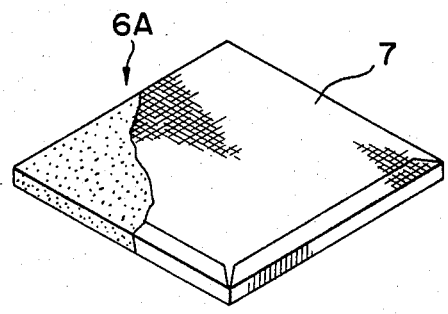
FIG. 3 is a perspective view, partly shown in section, of another embodiment of fusing agent according to this invention.

Among the above-said component materials, at least an oxidation exothermic agent, two or more carbonaceous fuels having different ignition temperatures and a liquid binder are fed into a tank 2 in an extrusion molding machine 1 such as shown in FIG. 1, and the mixture is stirred and mixed by a first screw 3, further kneaded uniformly by a second screw 4 and forced out from a slit 5A in a die 5 provided at the foremost end of the machine in the direction of feed to thereby from a sheet of fusing agent 6 which is continuously delivered out. This sheet of fusing agent 6 is dried and hardened and then cut into pieces of a determined size as shown in FIG. 2, and if necessary each piece is wrapped up by a non-woven fabric 7 to obtain a unitary sheet of fusing agent 6A of this invention such as shown in FIG. 3. Although the sheet of fusing agent 6A may not necessarily be wrapped up with a non-woven fabric cover 7, such covering is preferred as it proves helpful to keep shape of the sheet and also provides favorable properties such as flame retardancy at the time of ignition or safety during storage. The following embodiments treat the case where no non-woven fabric cover is provided.

Now the principle of this invention is described concerning both the case where the road marking paint is to be removed by using said fusing agent and the case where new marking is to be worked on the road surface.

Figure 4A:
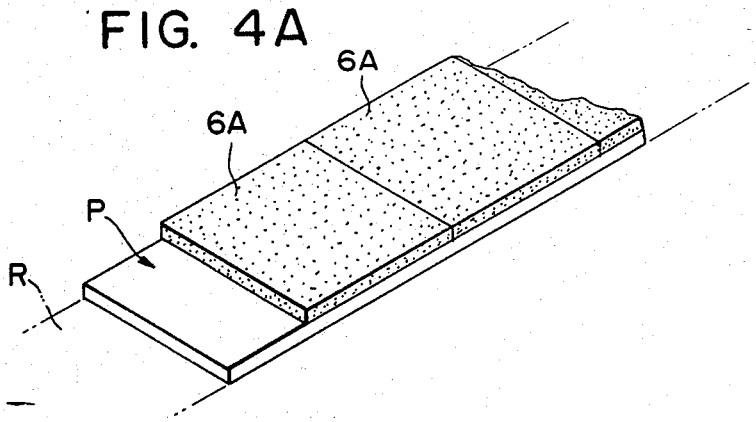
FIGS. 4A–4D are prespective views of the principal parts of the fusing agent as it was used for removing marks on the road.

Referring first to FIGS. 4A to 4D, there is illustrated a case where road marks are to be removed. First, sheets of fusing agents 6A, 6A . . . are laid side by side along the top face of the thermoplastic synthetic resin paint P stuck fast ont the road R as shown in FIG. 4A.

Figure 4B:
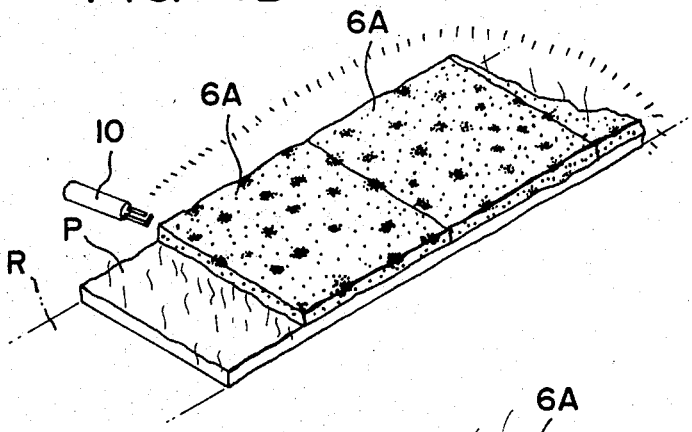
Figure 4C:
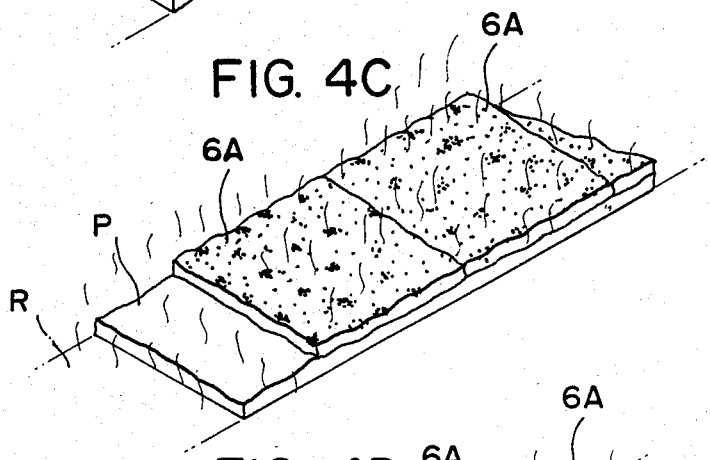
Figure 4D:
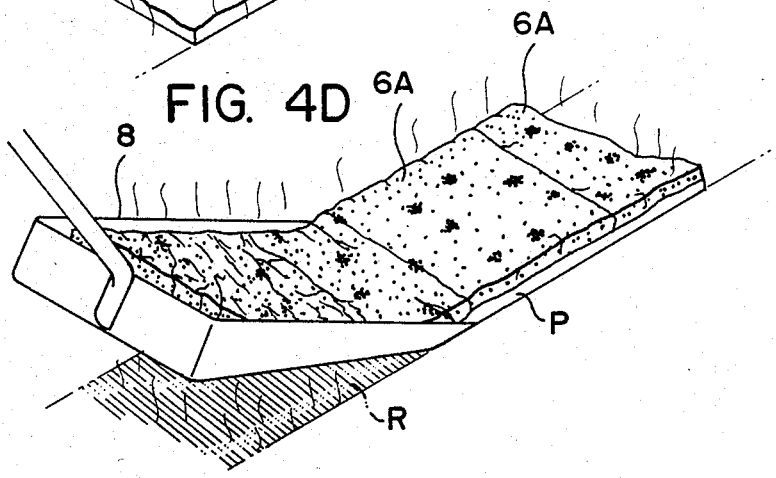

When a sheet of fusing agent 6A is ignited by a spark generator 10 as shown in FIG. 4B, the entirety of the sheet 6A is set afire by combustion of the oxidation exothermic agent and heated higher than the ignition temperature of the inflammable materials by the produced heat and the inflammable materials are burned successively from the one lower in ignition temperature to produce red hot carbonaceous "embers" as shown in FIG. 4C. Even after the oxidation exothermic agent has been burned out, said "embers" remain fixedly in the solid form on the paint P and keep burning for a given period of time, with the combustion heat thereof being directly conducted to the mark paint P therebelow to heat such paint P to a temperature higher than the melting point thereof to fuse it. The softened paint is scraped out from the road surface by using a scraper, shovel or the like means 8 as shown in FIG. 4D.

Figure 5A:
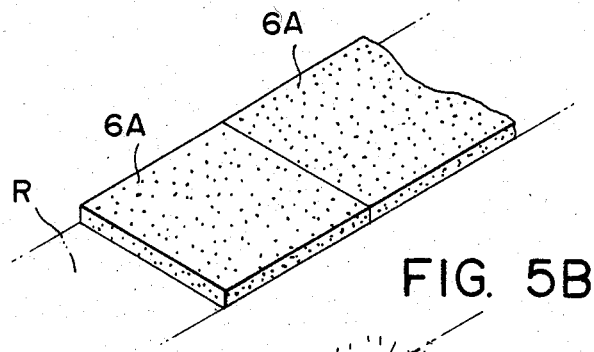
FIGS. 5A–5C are prespective views of the principal parts of the fusing agent as it was used for making new road marking.
Figure 5B:
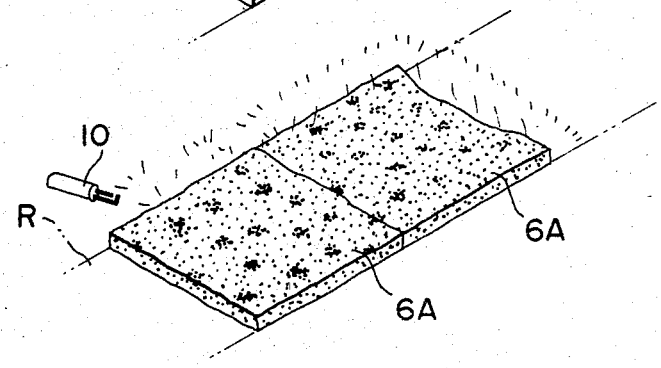
Figure 5C:
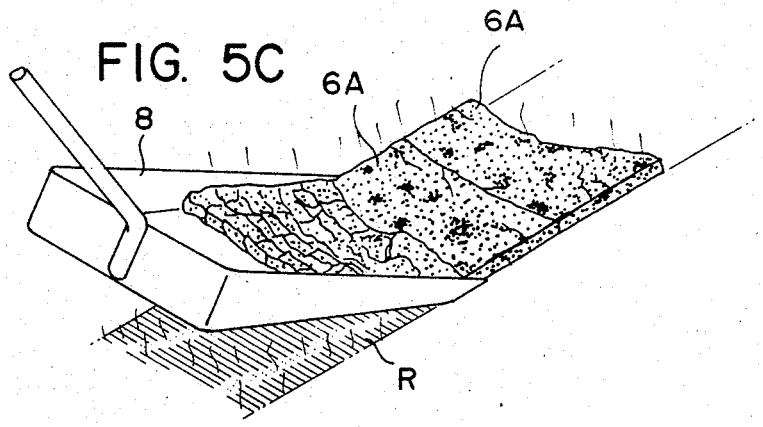
Figure 5D:
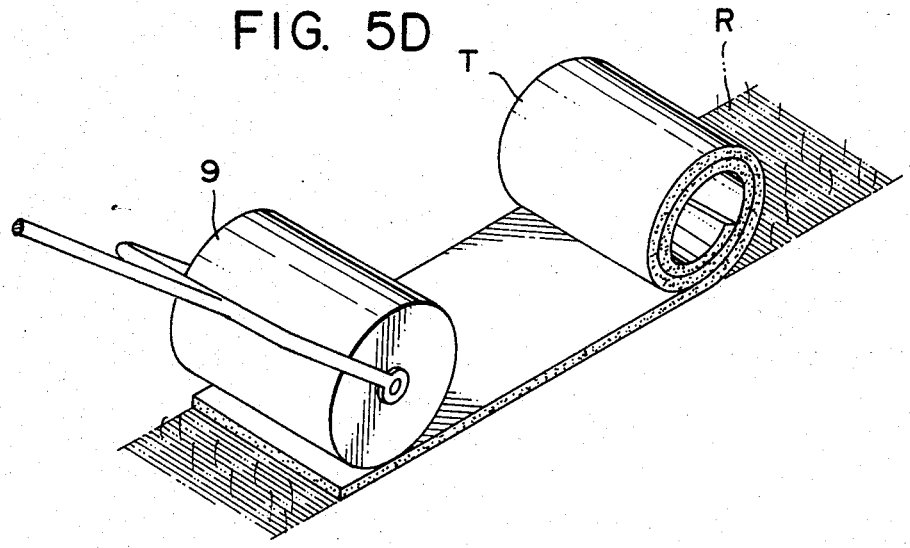

Referring now to FIGS. 5A to 5E, there is illustrated an example in which a marking tape principally composed of a thermoplastic resin is to be stuck on the road surface R. In this case, sheets of fusing agent 6A are first laid on the road face R to be worked, and then a sheet of fusing agent 6A is ignited by a spark generator 10 as shown in FIG. 5B, whereupon the combustion heat is conducted to the inflammable materials to let them burn to produce red hot "embers". These "embers" keep the red hot condition for a determined period of time to fuse the asphalt on the road surface. Then, the "embers" are scraped out from the road surface by using a scraper or shovel 8, and immediately thereafter, a traffic tape T is laid on the hot road surface area and pressed down by a roller 9, whereby a part of the traffic tape T is fused by the accumulated heat on the road surface so that the tape adheres fast to the heated area on the road surface. In case of using a non-woven fabric cover on the sheet of fusing agent, such cover is first burned out and then the inside inflammable materials are ignited. In this case, therefore, high-temperature ignition is required, but it is a safety requirement to make the sheet of fusing agent not easily ignitable with a match or such means.

Thus, according to this invention, each sheet of fusing agent is entirely set afire by ignition of the oxidation exothermic agent to decompose the oxidizing agent by the produced heat to ignite the inflammable fuel, thereby burning the component materials to form red hot "embers". The red hot condition of "embers" is maintained for a given period of time to get rid of the paint or other like material on the work surface or to newly adhere the marking material on the work area by utilizing the combustion heat of "embers". Combustion heat conduction between the red hot "embers" and the material to be worked is effected in a high-efficiency solid-to-solid heat conduction pattern, and even after the combustion of the oxidation exothermic agent ended, there are produced the carbonaceous "embers" as the fusing agent is mainly composed of combustible material, particularly charcoal, and such "embers" keep the solid-state red hot condition with little possibility of deformation or scattering even during combustion. Further, such "embers" can act as a heat insulator to prevent dispersion of heat during combustion to give a sufficient amount of heat to the material to be worked. In case of erasing a road sign such as paint adhering fact to an asphalt road surface, it is necessary to properly control temperature and volume of heat of the fusing agent so as to strip off the paint without damaging the asphalt.

Generally, the temperature gradient per unit temperature in the thicknesswise direction of the paint is reduced in inverse proportion to the temperature rise-up rate of combustion, so that when conducted heat reaches the asphalt surface with a high heat capacity, the temperature gradient rises up sharply to give the paint a sufficient amount of heat to effect fusion thereof before the asphalt surface reaches its fusing temperature, so at this point, the sign paint is quickly removed by using a shovel, scraper or other like means.

In case of applying a traffic tape on the road surface, such work can be accomplished with ease by dint of local heating since only the area to be worked is heated concentratedly by conducted heat of red hot "embers".

Figure 6:
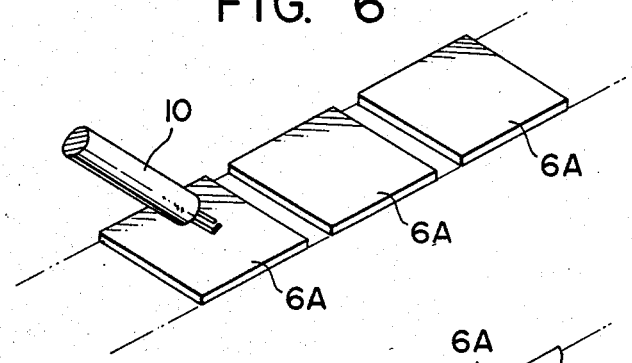
FIGS. 6 and 7 are perspective views of the principal parts of the fusing agent in the condition where said agent is just about to be ignited.
Figure 7:
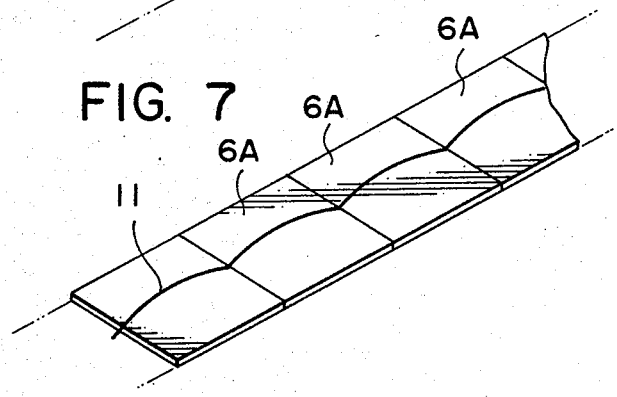

In the foregoing embodiments, if the sheets of fusing agent 6A are arranged slightly spaced-apart from each other and ignited successively by using a spark generator 10 as shown in FIG. 6, the produced flames are lessened and the operational timing can be easily controlled. For effecting continuous burning, two or more sheets of fusing agent 6A are arranged adjacent to each other and an end of the array of sheets is ignited by using a spark generator 10. A fuse 11 may be stretched along the surfaces of two or more sheets of fusing agent 6A laid on the material (such as paint) to be removed or on the area to be newly worked as shown in FIG. 7, and an end thereof is ignited to effect combustion.

Instead of covering each sheet of fusing agent with a non-woven fabric for giving flame retardency to the sheet at the time of ignition, a flame retardant may be directly applied to the surface of the sheet of fusing agent or said sheet may be clad with a heat-shrinkable tube. As another embodiment of fusing agent according to this invention, a plurality of small holes 12, 12, . . . may be formed in the entire surface of each sheet of fusing agent 6B as shown in FIG. 8. Such small holes 12, 12, . . . in the sheet allow positive intake of oxygen in the outer air. They can also serve as gas vents during combustion. The opening area of each of such small holes should be less than 0.8 cm, and the sum of the opening areas of the holes should be 20–30% of the total surface area of the sheet. These small holes 12 also prove effective for preventing floting or mitigation of the fusing agent by the produced gas.

Instead of molding the sheet of fusing agent by using an extrusion molding machine such as shown in FIG. 1, such sheet may be also worked by press molding. Also, using a specific die in the extrusion molding machine, it is possible to form a sheet provided with a plurality of air vents 13, 13 . . . at both end faces as shown in FIG. 9.

In still another embodiment of this invention, as in FIG. 10, a plate made of wood pulp cellulose or other inflammable plate-shaped material is used as base 14 and a mixed paste of the above-said components is applied to a predetermined thickness or impregnated on one or both sides of said base to form a sheet of fusing agent 6C of a laminate structure consisting of the base 14 and a fuel layer 15. In this case, it is recommendable to use an air-permeable porous plate or corrugated cardboard as base 14. Also, a plurality of small through-holes 12, 12, . . . are provided in the plate.

In the above-mentioned embodiments, the explanation was made about the removal of road marks carried out on a road from the latter and the execution for applying the road marks on the road. However, with the same process, the present invention can be applied to in cases of providing asphalt roofing on a roof or floor of a building or executing a work on a playground, garden, corridor or such with a heat-fused synthetic resin, synthetic rubber, etc., or removing them from the worked surfaces.

The invention is now described in further detail by way of the examples thereof.

EXAMPLE 1

To fine powders of 24 g of pine charcoal, 15 g of paulownia charcoal and 15 g of paper charcoal, 22 g of sodium nitrate and 8 g of manganese dioxode were mixed with a binder (CMC, a commercially sold starch (1% concentration)) under stirring and the mixture was extrusion-molded into the form of a plate, followed by drying to obtain a 16.5 cm wide, 16.5 cm long and 3–4 m/m thick sheet of fusing agent. This sheet of fusing agent was enveloped with a non-woven fabric, set on the marking paint adhering to the asphalt road surface and ignited by a spark generator. Immediately after ignition, flames propagated to the entirety of the sheet, and upon extinguishment of the fire in about 10 seconds, there were produced red hot "embers". Combustion lasted approximately 10 seconds, and the "embers" became separatable in 50–80 seconds thereafter. The "embers" which were left unremoved kept the red hot condition for 5–6 minutes after ignition.

EXAMPLE 2

To fine powders of 20 parts of paper charcoal and 90 parts of pine charcoal, 400 parts of sodium nitrate and 92 parts of bentonite were mixed in a carboxymethyl cellulose solution under stirring and the mixture was press-molded and dried to obtain a 16 cm wide, 16 cm long and 3 m/m thick sheet of fusing agent. This sheet was set on the fusible paint stuck on the asphalt road surface and ignited. The combustion spread at a proper rate and simultaneously producted high-temperature "embers". 10 seconds was taken till completion of combustion and removal of "embers" became possible in 10–30 seconds thereafter. The "embers" keep the red hot condition for 1–2 minutes, so removal of "embers" is to be completed within such period.

EXAMPLE 3

To 80 parts of pulverized anthracite and 20 parts of finely powdered paper charcoal, 10 parts of finely cut pieces of newpaper, 400 parts of sodium intrate, 6 parts of sodium perhydrochloride and 215 parts of glass powder were mixed in a carboxylmentyl cellulose solution under stirring and the mixture was applied on one side of corrugated cardboard and dried to obtain a 16 cm wide, 30 cm long and 3 m/m thick sheet of fusing agent, and this sheet was set on a working area in the same way as said above and then ignited and burned. Combustion was completed in approximately 20 seconds and the paint became separatable in 10 seconds thereafter. "Embers" kept the separatable state for 2 minutes.

EXAMPLE 4

To five powders of 80 parts of charcoal and 20 parts of paper charcoal, 5 parts each of flax yarn and tetron fiber, 400 parts of sodium intrate, 9 parts of sodium perhydrochloride and 87 parts of aluminum hydroxide were mixed in a methylcellulose solution under stirring and the mixture was press-molded into a 16 cm square and 4 m/m thick sheet of fusing agent, and this sheet was set on the asphalt road surface, ignited and burned. Combustion completed in approximately 15 seconds and upon lapse of 2 minutes thereafter, the "embers" were removed and a traffic belt (a factory product of a fusible paint shaped into a tape) was set in its place and pressed down by a roller to complete perfect adhesion of the belt on the road surface.

What is claimed is:

1. A method for removing an elongated heat-fusible road marking from a road surface comprising:

obtaining a solid fusing agent in the shape of a sheet having a width essentially the same as the width of the road marking to be removed, and composed of a particulate carbonaceous fuel, an oxidation exothermic agent, an igniting agent, and a binder, well mixed together;

laying the sheet on the surface of the road marking to be removed from the raod surface and aligning the sides of the sheet with the sides of the road marking;

igniting said igniting agent of the sheet to ignite said oxidation exothermic agent to in turn ignite said carbonaceous fuel to produce red hot embers distributed on the surface of the road marking;

permitting said embers to burn on the road marking surface for a time sufficient to conduct high temperature heat to the road marking to fuse the marking, and to cause at least some of the embers to adhere to the road markings; and before the embers extinguish and while the road marking is fused, simultaneously removing the road marking and the embers thereon from the road surface.

2. The method of claim 1 wherein said step of simultaneously removing the road marking and embers comprises scraping the road marking and embers from the road surface.

3. The method of claim 2 wherein said scraping comprises scraping the road marking and embers from the road surface with a scoop.

4. The method of claim 1 wherein said step of obtaning a fusing agent comprises, obtaining a fusing agent containing at least two particulate carbonaceous fuels with different ignition temperatures so that the fuel with a lower ignition temperature assists igniting the fuel with a higher ignition temperature.

5. The method of claim 1 wherein said fuels comprise different types of charcoal.

* * * * *